US006089301A

United States Patent [19]

Smith

[11] Patent Number: 6,089,301

[45] Date of Patent: Jul. 18, 2000

[54] SLIDING GLASS DOOR PRIVACY SCREENS

[76] Inventor: MaryAnn Smith, 1835 Bay Blvd., Point Pleasant, N.J. 08742

[21] Appl. No.: 08/511,436

[22] Filed: Aug. 4, 1995

Related U.S. Application Data

[63] Continuation-in-part of application No. 08/225,617, Apr. 11, 1994, Pat. No. 5,465,774.

[51] Int. Cl.[7] ..... E06B 3/32

[52] U.S. Cl. ..... 160/90; 160/368.1; 160/371; 49/70; 40/611; 52/202

[58] Field of Search ..... 160/90, 371, 368.1; 40/611, 594; 49/70; 52/202

[56] References Cited

U.S. PATENT DOCUMENTS

| | | |
|---|---|---|
| 4,133,367 | 1/1979 | Abell . |
| 4,272,934 | 6/1981 | Cowden et al. . |
| 4,398,586 | 8/1983 | Hall . |
| 4,416,096 | 11/1983 | Schuster et al. . |
| 4,453,585 | 6/1984 | Ruggeberg, Sr. et al. . |
| 4,486,990 | 12/1984 | Bauch . |
| 5,465,774 | 11/1995 | Smith . |

*Primary Examiner*—Blair M. Johnson

[57] ABSTRACT

A decorative window covering provides privacy on sliding glass doors or windows without altering the walls surrounding the door or window. These privacy screens are functional as well as decorative and can remain within a sliding window or door frame when opening or closing the window or door.

1 Claim, 6 Drawing Sheets

SLIDING GLASS DOOR PRIVACY SCREENS

The present case is a continuation-in-part of Ser. No. 08/225,617, filed Apr. 11, 1994, now U.S. Pat. No. 5,465, 774.

BACKGROUND OF THE INVENTION

1. Field of the Invention

The present invention relates generally to decorative window treatments and, more particularly, is concerned with a privacy screen adaptable to sliding glass doors or any framed sliding window. However, this invention may also be applied to any type of door or window whether stationary, swinging or sliding. The privacy afforded by these screens provides, as much, if not more, than any type of conventional drapery, shades or blinds.

2. Description of the Prior Art

In recent years, there has been a tremendous growth in new home building and home renovation and, as such, the various providers of home related products has expanded greatly. Such highly promoted home improvement articles include sliding glass doors that allow more convenience and attractive access to deck and patio areas. The unexplored area of providing convenient and attractive window coverings to these sliding windowed doors is a method or invention that is to be described. No other article of manufacture exists that creates such an efficient and simple method of providing decorative privacy for sliding glass doors. Presently, and prior to this time, achieving any level of privacy to sliding doors called for the use of a vertical blind system attached over the door frame of the sliding door structure and necessitated the constant manual repositioning of these blinds when entering or exiting the sliding doors.

Although the vertical blind system ("verticals"), or variations of it, has been used extensively with sliding glass doors, it does have drawbacks. To be utilized, these blinds must be installed and therefore, screwed into the existing walls causing alteration to the home. The "verticals" also must be drawn back and forth when walking through the doors and if not, the verticals can sustain damage. The vertical blinds hide the natural beauty of the sliding door frame itself and if not fully closed do not provide total privacy.

Consequently, a need exists for a new and innovative method of providing a privacy covering for sliding glass doors.

SUMMARY OF THE INVENTION

The present invention provides privacy with a decorative as well as multi-functioned advantage. The privacy screens (hereinafter "inserts") are removable, lightweight, can be either translucent or opaque (depending on the desired covering material) and can be stored when not placed on the window frame. Such storage can either be behind a piece of furniture or the insert can be hung upon a wall as a decorative show piece since the article is lightweight and easily movable. The inserts, usually used in pairs, can be built on a frame or can be of a plurality of materials, soft or rigid, and/or collapsable and manufactured to fit within the sliding door's window area. The insert can have any color scheme or any type of artwork that will conform to the desired interior decorating and may offer a pleasant translucency for daytime use and/or an opaque quality at night.

When correctly in place, the insert fits snugly and flush to the window frame of the sliding door so that the inserts may remain within the doors and slide past each other when the doors are opened and closed. There would be no need to remove these inserts or to make any adjustment to them when utilizing the sliding doors. The inserts can be easily removed by the user, at the users discretion, since the insert itself, can be held in place by a plurality of fasteners, including but not limited to, fasteners placed inconspicuously between the insert and the window of the sliding door, or between the insert and the frame of the sliding door or held flush to the window by fasteners placed on the outer surface of the door's framework.

Although the main utility of these inserts would correspond to sliding doors, these inserts can also be utilized on any type of recessed panel set within any type of door or window, including but not limited to swinging and stationary doors and windows. The frame of the invention which is inset and placed on the window may be made of any rigid material which could include wood, plastic or aluminum and/or any other rigid material and, in essence, would resemble the framework upon which a canvas artwork is placed, for example. This framework would have the ability to have a fabric or other such covering attached thereto, to serve as the privacy element of this invention. The material and/or covering may be made of cloth, fabric and/or other pliable material that can be attached to said framework by any method including stapling the covering to the interior of the framework to achieve a snug fit around said frame.

Once the material is attached to the framework, the material and said frame may thereafter be inset onto the glass of the door and held in place by any means of fasteners which can include attaching Velcro™ onto the back side of the frame and to the window itself.

Another means of attaching or adhering the frame and covering to the window of the door can be achieved by placing the frame and covering onto the window and holding the invention in place with a hook and staple design, which is manufactured by Stanley Hardware, Model No. 80-3640 and entitled 'Solid Brass Hook and Staple'. The hook portion of the hardware is installed directly and adjacent to the window portion of the door and is manufactured as to create a flush finish with said door. The hook portion of the hardware does rotate on a small screw which fastens it to the wood door. The staple portion of the hardware is optional in its use, but, if so desired to be used, can be attached to the framework of the invention itself.

DESCRIPTION OF THE PREFERRED EMBODIMENTS

Figure 1:
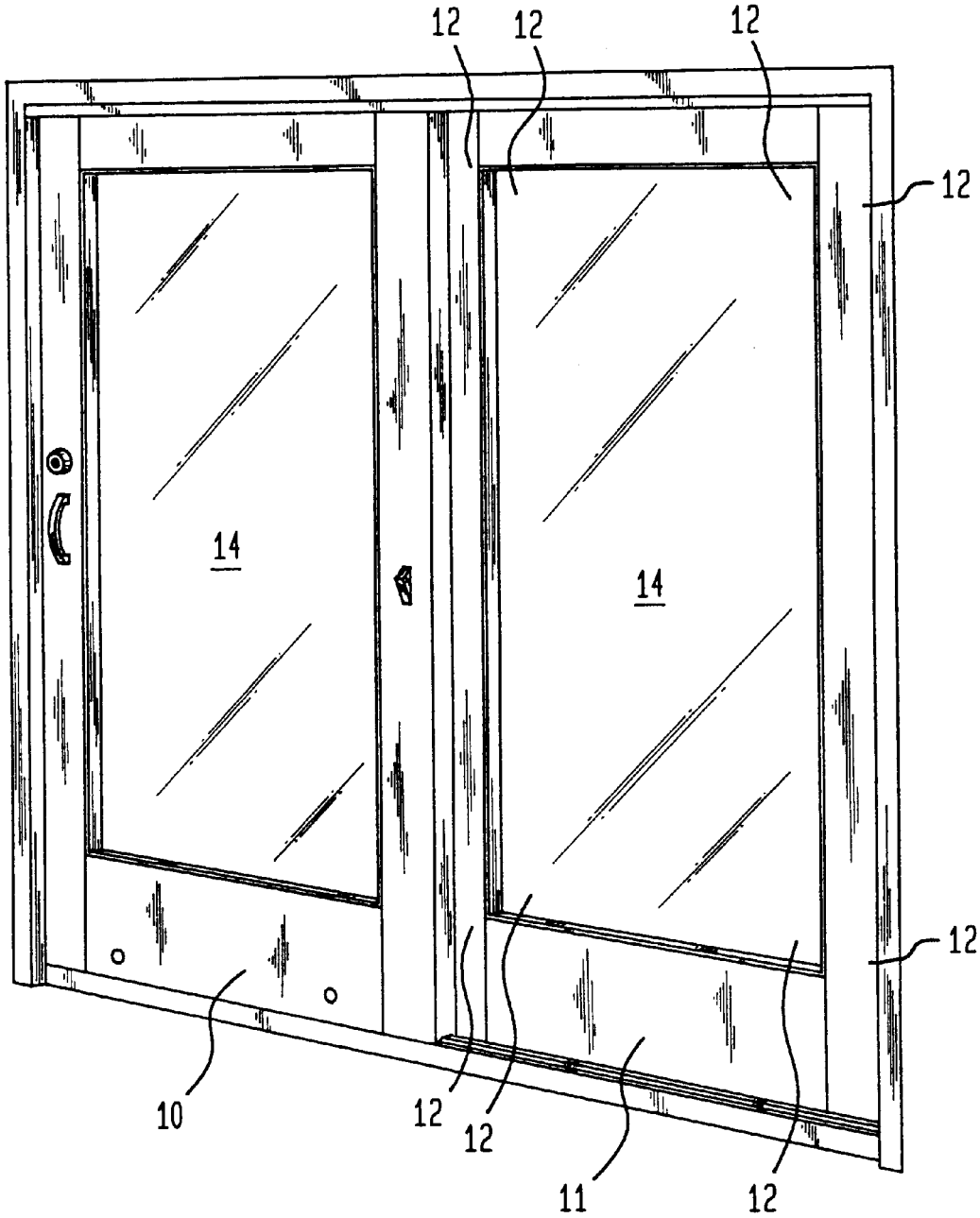
FIG. 1—a perspective view which depicts sliding doors and window areas within which the sliding glass door privacy screens ("privacy screens") would be placed.
Figure 6A:
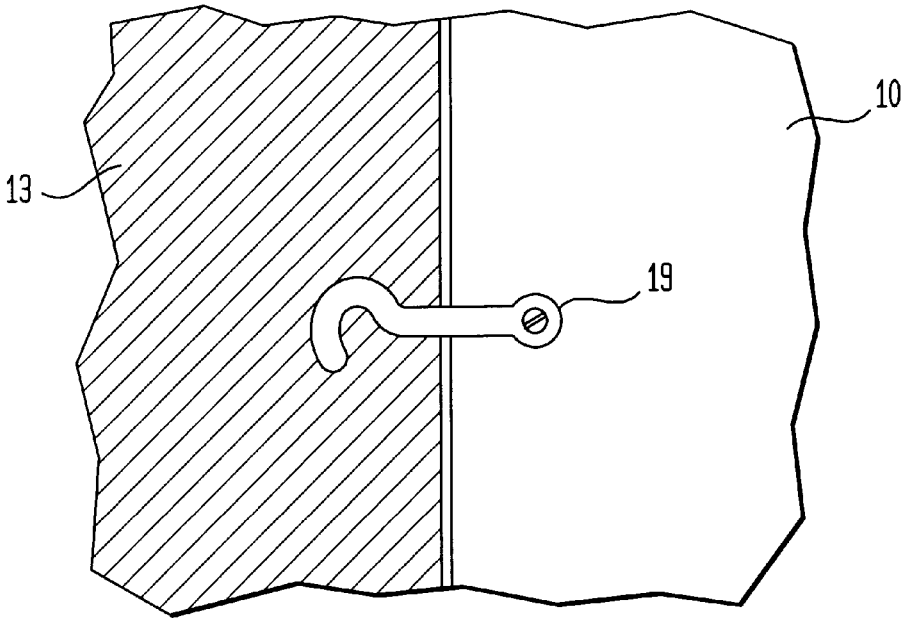
FIGS. 6*a* & *b*—depict an example of one of the plurality of methods to fasten the privacy screens on to the window of the sliding door.
Figure 6B:
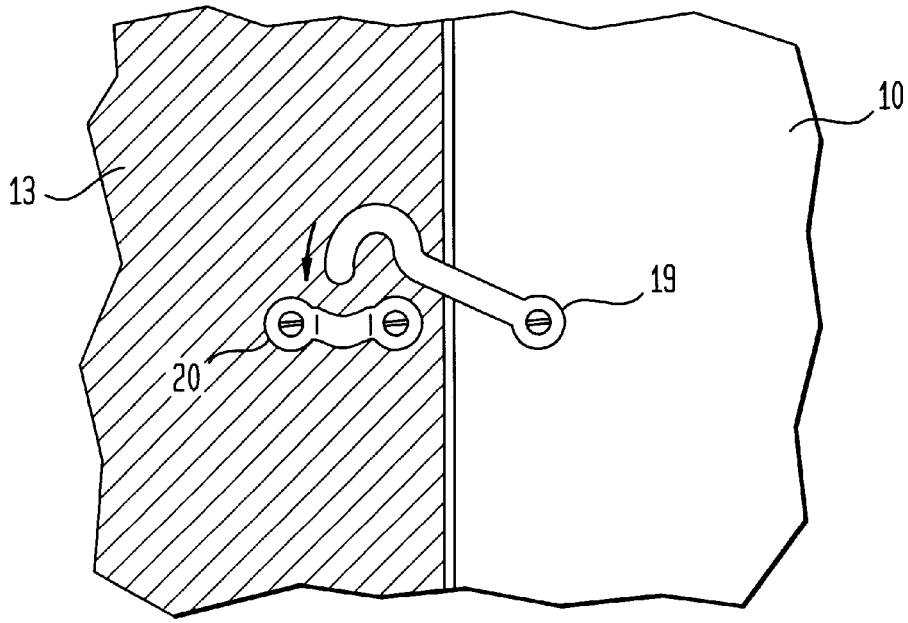

Referring now to the drawings, and more particularly to FIG. 1, there is shown an interior view of a sliding door whereby in this example the left hand door 10 would slide to the right, past the stationary right side door 11. The privacy screens are placed on window 14 of the sliding door. Examples of the placement of the plurality of fasteners 12 are noted on the window area 14 or on the framework on the sliding door, which can include, but not limited to, the referenced Velcro™ method of attachment from privacy screen to the window 14 or the "Hook and Staple"™ method, as seen in FIG. 6*a* and 6*b*, of attachment from the door frame to the privacy screen.

Figure 2:
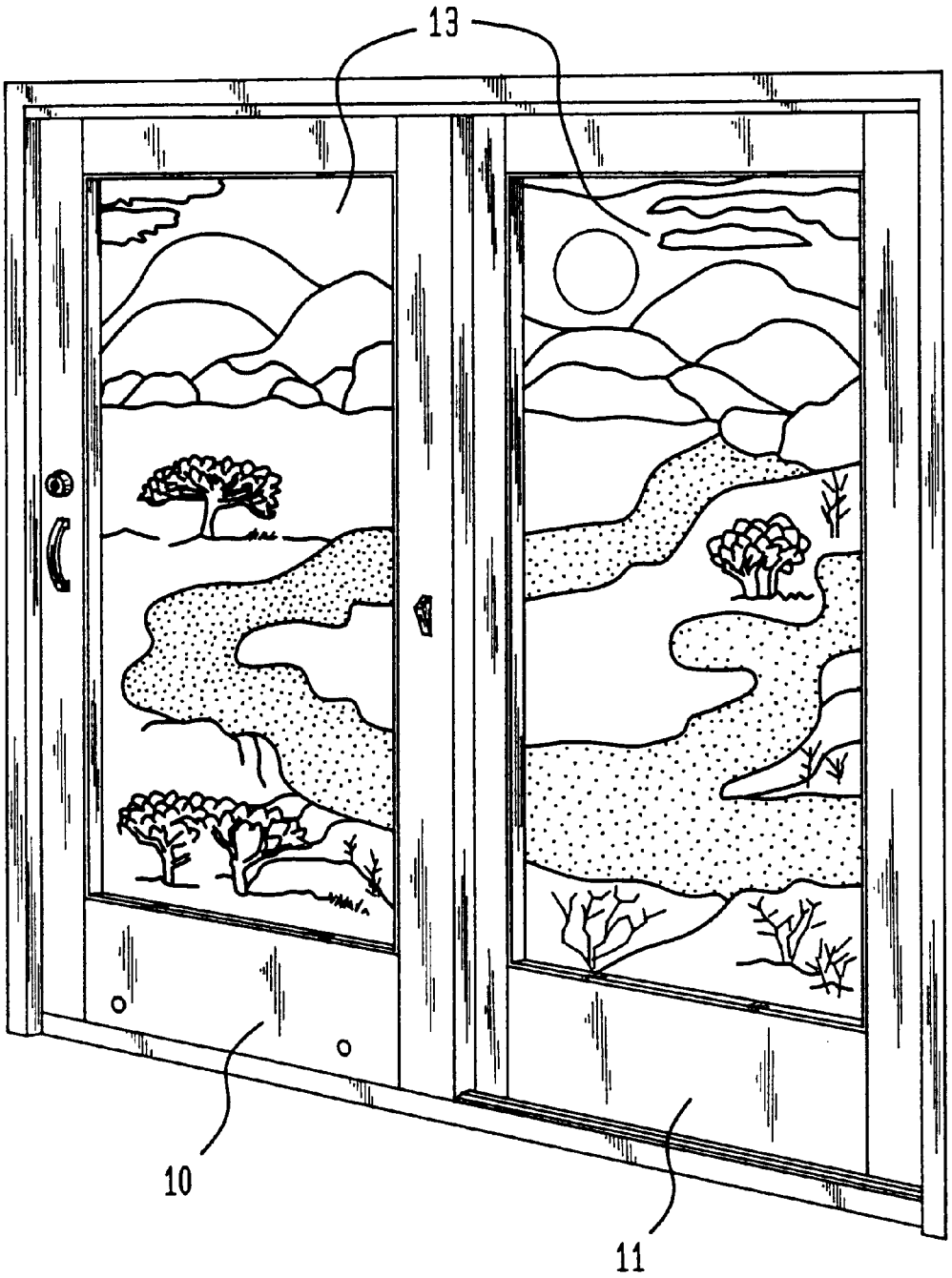
FIG. 2—a perspective view showing the privacy screens in place on the closed sliding doors (showing sample pattern).

FIG. 2 depicts the privacy screen 13 on the window area of the sliding doors 10 and 11 held in place by one of any of the plurality of fasteners. A sample design of artwork is shown on the privacy screen 13. The artwork, colorscheme and type of design on the privacy screen 13 can vary to conform to the interior decorating.

Figure 3:
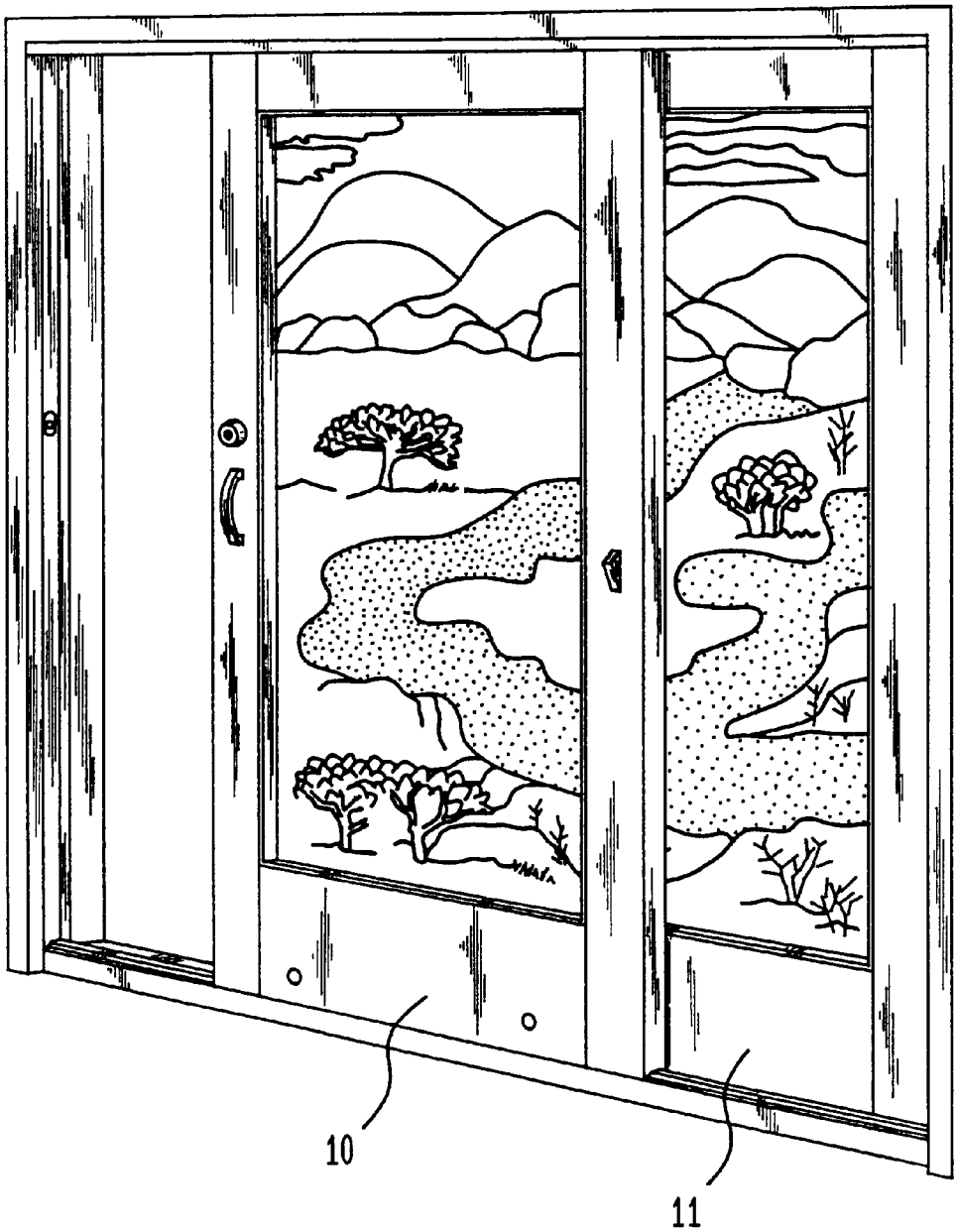
FIG. 3—depicts a perspective view of the privacy screens in place on sliding doors which are open.

FIG. 3 shows the privacy screens 13 in place on the window 14 and the left sliding door 10 in the open position. Noted is the usefulness and uniqueness of the ability to slide the left door 10 without the removal of the privacy screen in place on the window of the right door 11.

Figure 4:
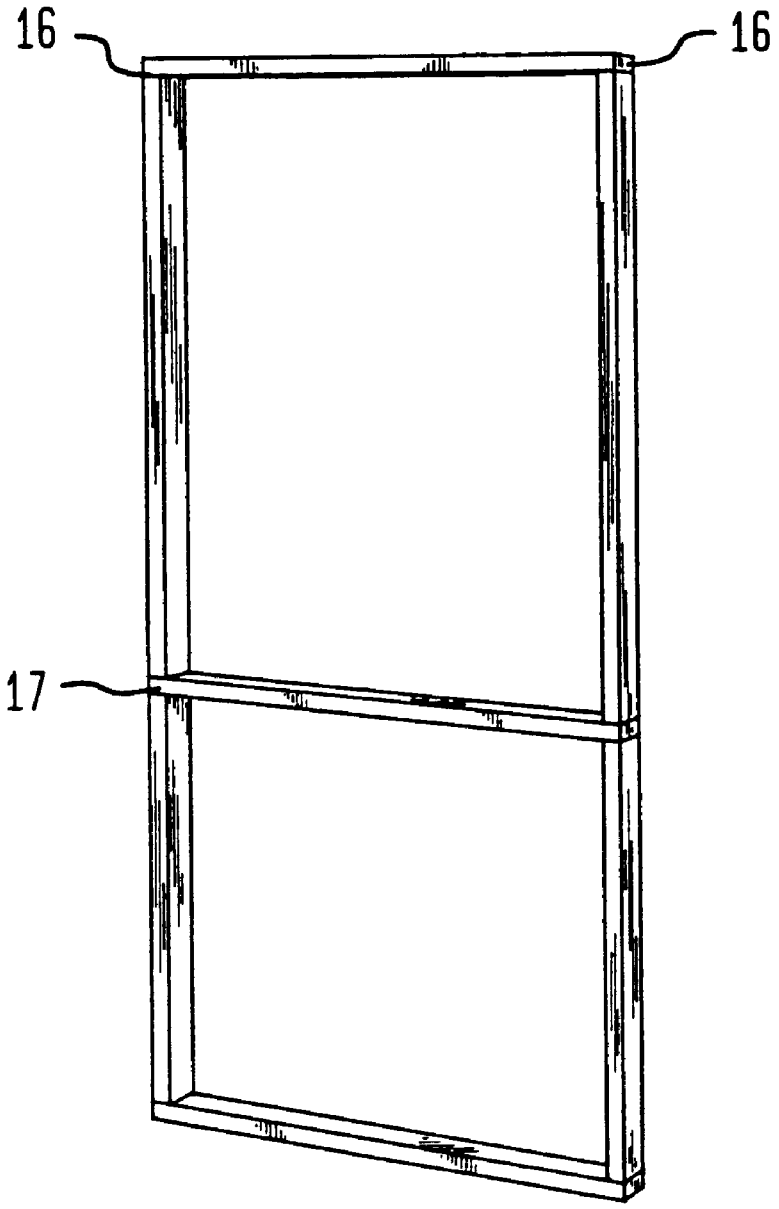
FIG. 4—depicts the frame of the privacy screen, standing alone.

FIG. 4 depicts the three dimensional perspective view of the framework 16 (which would be covered by privacy screen material) and a typical placement of a crossbeam 17 to add strength and rigidness to the frame 16.

Figure 5:
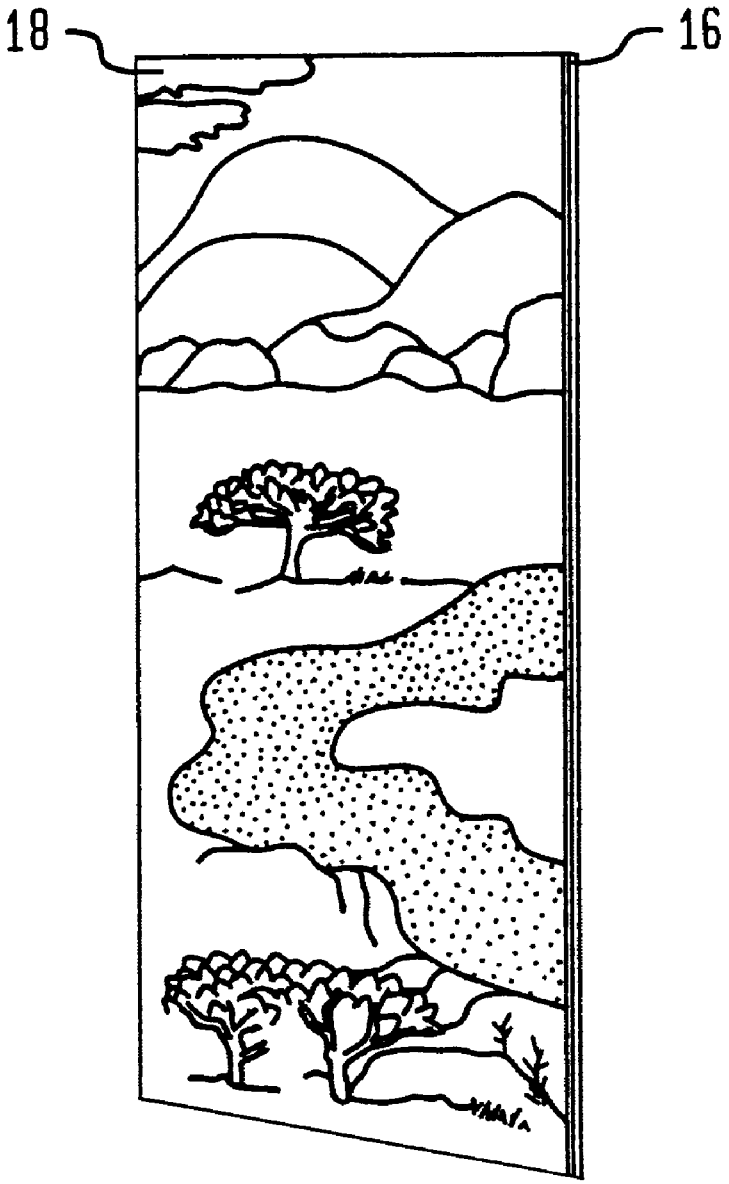
FIG. 5—depicts the covering material upon the frame.

FIG. 5 depicts the frame 16 covered with the privacy screen material 18.

FIG. 6*a* and 6*b* depict a sample of any of a plurality of fasteners 19 which hold the privacy screen 13 in place and flush to the window 14 of the sliding door 10. In this drawing the "Hood" 19 portion would be attached to the door 10 and positioned to hold the privacy screen 13 in place. It should be noted that, although the "Staple" 20 is depicted, its use is not necessary to achieve the ability of the "Hook" 19 to hold the privacy screen 13 in place.

I claim:

1. A sliding closure in combination with an air permeable, non-insulating privacy screen comprising:

at least one closure member comprising a substantially rigid first frame having opposed outer surfaces and inner edges defining a perimeter, and a transparent panel located within said first frame and extending between said perimeter, said panel being recessed with respect to at least one of the outer surfaces of said frame;

at least one screen member comprising a second frame and a flexible air permeable, non-insulating decorative material fitted thereon, said material being of a substance to at least partially prevent viewing therethrough, said second frame being substantially the same size as said transparent panel and having the ability to be mounted on to the transparent panel, by a plurality of fasteners;

wherein when said second frame is removably mounted on said first frame by said plurality of fasteners, said second frame would be located within said perimeter and not extend beyond the respective said outer surface.

* * * * *